United States Patent [19]

Goellner

[11] 4,417,458

[45] Nov. 29, 1983

[54] PATTERN MATRIX FOR SKIVING SHOE PARTS

[75] Inventor: Robert F. Goellner, Creve Coeur, Mo.

[73] Assignee: Manufacturers Supplies Co., St. Louis, Mo.

[21] Appl. No.: 301,880

[22] Filed: Sep. 14, 1981

[51] Int. Cl.[3] ..... A43D 8/28; A43D 8/48; C14B 1/02

[52] U.S. Cl. ..... 69/13; 69/21.5; 12/58; 12/62; 12/146 C; 33/5; 36/47

[58] Field of Search ..... 36/45, 46.5, 47, 48, 36/49, 1; 12/62, 58, 63, 146 C, 146 CK; 33/3 R, 4, 5, 6; 69/9, 12, 13, 15, 16, 21.5

[56] References Cited

U.S. PATENT DOCUMENTS

| | | | |
|---|---|---|---|
| 289,145 | 11/1883 | Safford | 12/58 |
| 373,451 | 11/1887 | Frost | 33/5 X |
| 488,303 | 12/1892 | Beach | 12/63 X |
| 801,673 | 10/1905 | Moore | 69/21.5 X |
| 946,844 | 1/1910 | Keats | 69/21.5 X |
| 2,065,734 | 12/1936 | Pierson | 33/5 |
| 3,031,873 | 5/1962 | Bretts, Jr. | 69/13 X |

FOREIGN PATENT DOCUMENTS

| | | | |
|---|---|---|---|
| 1144564 | 3/1969 | United Kingdom | 12/146 C |

*Primary Examiner*—James Kee Chi
*Attorney, Agent, or Firm*—Paul M. Denk

[57] ABSTRACT

In a patterned matrix for use in conjunction with the skiving of shoe parts upon a splitter machine, the pattern matrix being applied contiguous with the intended shoe part for application to the machine, the pattern matrix including along its edge a relief or raised portion that urges the aligned edges of the shoe part into a greater skiving out than any other portion of the shoe part, and another relief being of greater density, comprising a cord, arranged within the first relief or raised portion and effecting during skiving a deeper cut into the intended shoe part to assure a uniformly weakened area for forming the fold line for the shoe part when being fabricated into a shoe component. A pair of patterned matrixes may be adhered together, as through a pressure sensitive material, with the relief member therebetween, for allowing usage of the patterned matrix for forming skived edges upon shoe parts of reverse proportions, as where each may be constructed into a pair of shoes.

17 Claims, 5 Drawing Figures

PATTERN MATRIX FOR SKIVING SHOE PARTS

BACKGROUND OF THE INVENTION

This invention relates generally to an apparatus and its method of use for skiving shoe parts and assuring uniformity in the formation of folded edges for the shoe parts or components derived during usage of this invention.

The skiving of shoe parts for removing superfluous portions of the hide, particularly along marginal edges, is an art well known, and has been in existence for centuries. Generally, and even to this date, skiving is used in the forming of shoe parts, primarily along those edges for the shoe part that are to be folded over to provide a pleasingly appearing but durable edge, as for example, at the location of the shoe opening where the foot enters the same. But, the specific fold that is made along this cut edge of the shoe part is never uniform in location, since the entire skived edge furnishes a weakened area where the fold may be made anywhere along its width, usually being determined only through the application of gauging mechanisms upon the machinery used in forming these folded edges upon the parts to be fabricated into shoes.

The current invention is intended to remedy and obviate the irregularities experienced in fabricating these marginal edges for shoe parts, by providing a deeper line of skive within the normally skived edge for the intended shoe part, so as to assure that folding always takes place in alignment with that weakened line or portion.

It is, therefore, the principal object of this invention to provide a pattern matrix having a double relief margin along its edge for furnishing the pattern not only for the skived edge for the shoe part, but to assure an additional depth of skive in alignment with the intended line of fold for the prepared shoe part.

Another object of this invention is to provide the arrangement of means of greater density within the relief means that forms the pattern for inducing a greater depth of skive along the edge of a shoe part, so as to furnish and assure that deeper cut along the shoe part edge where folding will always occur and is assured.

Still another object of this invention is to provide a pattern matrix which contains a tacky substance along one surface, and which may be pressure sensitive for adherance with another matrix of reverse proportions, having the relief means intermediate thereof, so as to allow the pattern matrix to be used for skiving shoe parts of reverse proportions, as for use in the fabrication of components for a pair of shoes.

Another object of this invention is to provide a pattern matrix for use in the skiving of shoes and wherein that surface upon which the intended shoe part applys may be formed of an abrasive or frictional material so as to assure the simultaneous movement of the said matrix and shoe part through through the splitter machine during part fabrication.

Yet another object of this invention is to provide a relief means for the matrix for use in conjunction with the manufacture of shoe parts upon a splitter machine, and wherein one part of the matrix has a greater density, as being formed from a nylon cord, and insertable within the other portion of the relief means and for providing skiving to double depths along the marginal edge of the intended shoe component.

Another object of this invention is to provide a method for furnishing skiving to a double depth at the marginal edges of shoe parts during their preparation.

These and other objects will become more apparent to those skilled in the art upon reviewing the summary of this invention, and upon undertaking a study of the description of the preferred embodiment in view of its drawings.

SUMMARY OF THE INVENTION

This invention contemplates improvements in the formation of shoe parts and from a specific styled pattern matrix used in conjunction with the skiving of particular edges of said parts during their fabrication. Shoes are generally constructed from leather and a great variety of other hides, and in their assembly, as is well known, the edges are generally skived so as to provide for their weakness at this location, to allow their folding thereat, stitching in place, so as to form generally smooth exposed edges at various locations within the shoe, as where the foot inserts, or at those locations where a couple of shoe parts may be brought together for stitching. In either case, but particularly where the edge is to be folded over to provide an attractive yet durable edge that is exposed in the constructed shoe, it is desirable that uniformity of folding be accomplished at these locations, and such can be assured through the usage of the especially fabricated pattern matrix forming the concept of this invention.

This pattern matrix includes a base material that may be formed from a fiber, or other soft composition, and which, in this invention, may be modified in its formation to provide an abrasive surface, such as one resembling emery paper, and to which the shoe part may be frictionally adhered during passage of these components through the splitter machinery. The opposite surface of the matrix may be simply the exposed surface of the fibrous or other material forming the matrix, or in the alternative, may have a pressure sensitive tacky substance applied thereto, coated with polyethylene or some other film, and which may be readily peeled from the surface to expose said tacky substance for application of another pattern matrix of reverse proportions to this opposite side of the same. The value of this is that a pattern matrix fabricated in this manner may be used for processing shoe parts of reverse proportions, such as, for example, shoe quarters that may be fabricated into the left and right parts of a pair of shoes.

Applied to the reverse surface of the aforementioned pattern matrix is a relief means, in this particular instance, also comprising some type of fibrous material, or other type of material, which is reasonably soft in texture, not of too great of density, but at least being sufficiently pressure resistant so as to adequately force the overlying and contiguous shoe part, and particularly those edges aligned with the location of this relief means upon the pattern matrix, deeper into the blade of the splitter machine to assure adequate skiving at least along the marginal edges of the intended shoe parts, and where skiving normally is desired. But, as previously reviewed, another aspect of this invention is to assure that the skived edges for the intended shoe parts will precisely fold at the same locations, to assure uniformity in the fabrication of shoes from these parts, and to attain such, the relief means of this invention includes another component within its structure, being of greater density than the relief means itself, that also having a slightly greater dimension than the thickness of the relief means itself, so as to assure that additional depth of skiving occurs along the length of this added component and which furnishes greater weakening of the shoe part even within its skived edge. Hence, and in this embodiment, this additional dense material may comprise a cord of material, such as nylon, or some other polymer, which is located within a groove generally arranged along the midpoint of the said relief means, running co-terminus therewith, so that as the pattern matrix containing these components is used in the skiving of a shoe part, not only does the relief means assure that adequate skiving takes place along the marginal edge of the shoe part, but that an additional depth of skiving occurs as a result of the location of this cord, being of denser material, thereby forcing the shoe part deeper into the blade of the skiver at this precise location, and furnishing this weakened line within the skived area and along which uniform folding of the shoe part will be assured.

In the method for fabricating shoe parts through the use of the pattern matrix of this invention, the combined matrix and the forming shoe part are aligned with each other, with normally the material forming the intended shoe part being arranged facing downwardly, and together they are fed into the splitter machine for obtaining skiving of said parts at those locations where the relief means, in addition to the extra dense cord, force the leather or other material of the shoe part deeper into the blade of the splitter machine.

DESCRIPTION OF THE PREFERRED EMBODIMENT

Figure 2:
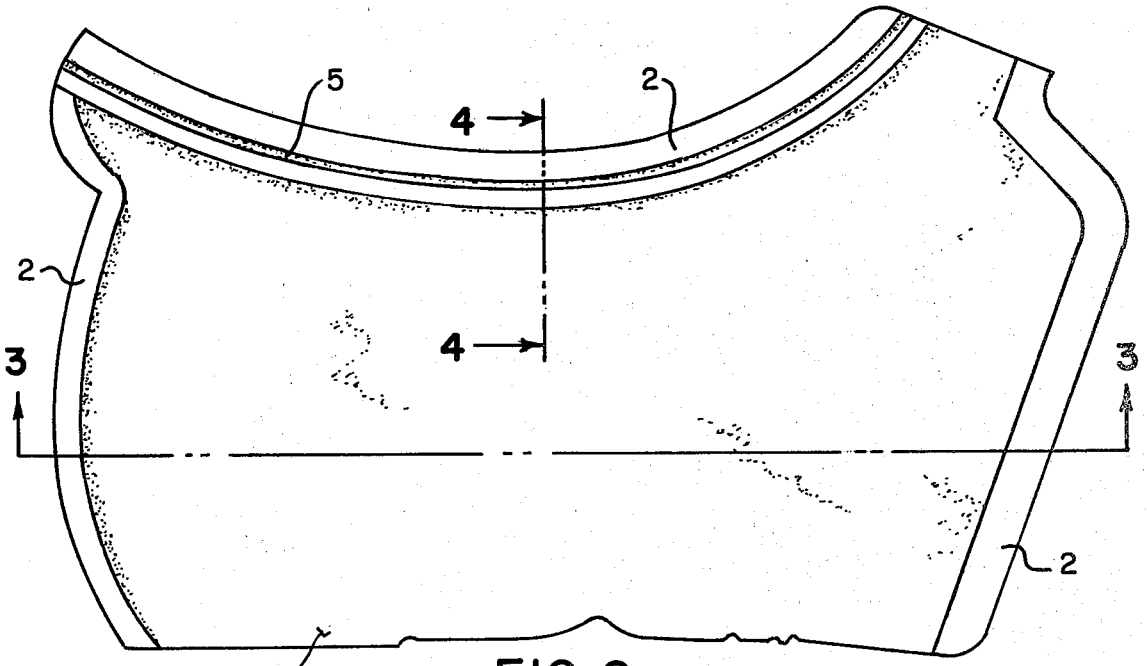
FIG. 2 provides a plan view of the pattern matrix for this invention shaped into the intended design for a shoe quarter, and disclosing the relief means arranged along various and select marginal edges where skiving is desired for the intended shoe parts.

In referring to the drawings, and in particular FIG. 2, a pattern matrix 1 of this invention is disclosed, and in this particular instance, generally undertakes the shape of a shoe quarter that is fabricated into a configured shoe during its manufacture. This matrix includes a series of marginal edges that incorporate the relief means 2 of this invention, and with this relief means generally in the form of a raised strip or portion of material, generally of some type of fiber, or the like, and which elevates the thickness of the identified marginal edges of the matrix at those locations where the shoe part, in this particular instance, a shoe quarter, needs some thinning along its edges, either for the purose of accommodating stitching to other shoe parts, or to allow for edge fold over, and then stitching or glueing, in furnishing an outer edge for the finished shoe. In this particular instance, where the matrix for a shoe quarter is shown, the left and right edges having the relief means 2 located thereat furnish skived stitching edges for the shoe quarter, while the upper marginal edge 2 provides a skived edge that is folded over into a finished edge for the fabricated shoe.

Figure 3:
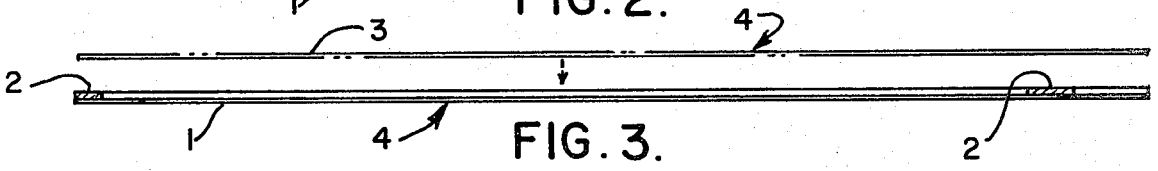
FIG. 3 discloses the pattern matrix of FIG. 2 but showing an additional matrix being applied to the opposite side of said first shown matrix for furnishing a pattern matrix that may be used for furnishing skiving of shoe parts of reverse propostions.

As can also be seen in FIG. 3, the matrix 1 is of a thin dimensional material, while the relief means or raised portions 2 do have the extra thickness as explained.

Another advantage of this invention is that the material forming the pattern matrix 1 may comprise a thin emery paper like material, having the abrasive or high frictional surface provided to one side, that being the opposite side from that shown in FIG. 2, so that leather or other intended shoe parts applied to it will be held in place, to assure proper alignment and attainment of skiving edges at those locations where desired, and to prevent slippage of the part during its fabrication. The opposite side of the pattern matrix, and that side shown in FIG. 2, may contain a tacky surface, such as containing a layer of pressure sensitive adhesive, and having an overlying layer of a protective film material, such as polyethylene, so that the tacky surface can be preserved until such time as it is desired to be used.

As can be also seen in FIG. 3, the pattern matrix of this invention may be formed for double usage, that is to provide a matrix that is reversible in usage, and can be fed into the splitter machine upon either side, thereby furnishing a pattern that can be used with shoe parts of identical but reverse proportions, as for example when such parts are to be included as components into a pair of left and right shoes. As shown, another layer of the material forming the pattern matrix, as at 3, is brought into contact with the first said pattern matrix 1, and its relief means 2, in order to furnish a pattern that is usable upon both of its sides. Each exposed surface, as at 4, may contain the abrasive, emerylike surface in order to provide sufficient friction for adhering and holding the intended shoe component through it as it is being fed through the skiver. In addition, the inner surfaces of each of the matrix materials 1 and 3 may contain the pressure sensitive tacky surface, as previously explained, for the purpose of allowing permanent adherance of these two components together. By simply peeling off the aforesaid protective film and thereby exposing their tacky surfaces, the two matrixes can be brought together into a complete and duo patterned matrix.

Another attribute of this invention is the provision of means for providing differential in the depth of skiving to be obtained upon the intended shoe component as it is fed through the splitter machine. As can be seen in FIG. 2, the relief means 2 forming the upper marginal edge for the shoe part contains an aligned length of greater density material, that is material having a greater density than the relief means 2 itself, and in this particular instance, it comprises a nylon or polymer cord 5 that does not succumb to the pressures of the rollers of the splitter machine as the pattern matrix and overlying contemplated shoe component are fed through the same, so that while the relief means 2 provides some degree of skiving of the edge of the shoe part, along the length of the cord 5, the shoe part skived edge will receive a greater depth of skive, thereby furnishing a weakened fold line at that precise location to facilitate the uniform and accurate folding over of the edge during shoe manufacture. As previously explained, obtaining uniformity of folding for the edge of a shoe currently is a hit and miss proposition, and while folded edges are certainly obtained thereby, they cannot be acquired as uniformly as can be done through the usage of the supplemental relief means 5 when emplaced in alignment along the length of the upper means 2 as shown.

Figure 4:
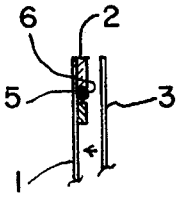
FIG. 4 discloses, in greater detail, the application of a pair of pattern matrix with the relief means, in addition to the denser cord intermediate the same during the construction of this type of a matrix.

As can be seen in FIG. 4, when the pattern matrixes 1 and 3 are brought together, with the relief means 2 located therein, the cord 5 will have previously been inserted within a slot 6 formed in said relief means 2, with the cord having a slightly greater dimension than the thickness of the means 2, to assure a double thickness in the amount of skiving obtained upon passage of the matrix and shaped shoe component through the splitter machine.

Figure 5:
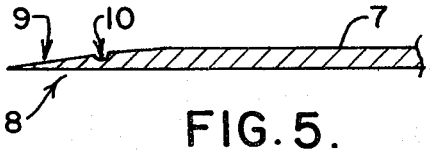
FIG. 5 discloses a skived edge of a shoe part for this invention.

This can be more accurately seen in FIG. 5, which may comprise the upper marginal edge of a shoe part, which may have been passed through the splitter machine in conjunction with the pattern matrix as shown in FIG. 2, wherein the shoe part 7, which in this instance may comprise the part of a shoe quarter, vamp, shoe upper, or the like, has its marginal edge, as at 8, subjected to some amount of skiving, as shown along 9, obtained as a result of the pressure from the relief means 2 forcing a greater amount of the leather or other material forming the shoe part 7 deeper into the blade of the splitter machine, while the cord 5 within the relief means causes a deeper depression of skiving cut, as shown at 10, and about which this edge may be uniformly folded due to the greater weakness obtained at the location of this skived groove 10.

But, where skiving is performed along the edges of the shoe part, from the patterned matrix is shown in FIG. 2, since the relief means 2 located to either side of the matrix do not contain a cord 5, then the skive obtained will be identical to that which is shown at 9, in FIG. 5, without any further skived depression 10 being exhibited, due to the lack of cord in the side relief means 2, as shown.

Figure 1:
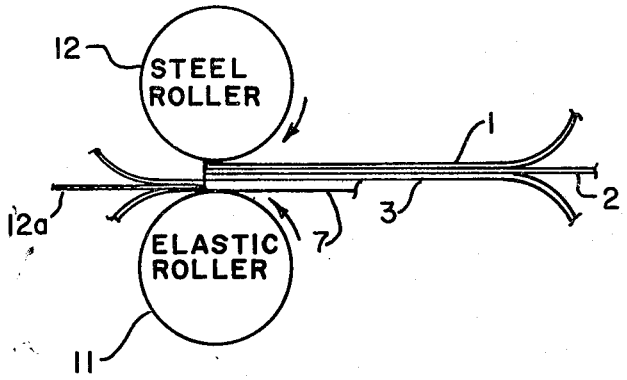
FIG. 1 provides a schematic view of the matrix of this invention with the underlying leather or other material forming the intended shoe part being fed intermediate the rollers of the splitter machine and into the skiving blade for the same.

In the method of performing the type of skiving previously explained, FIG. 1 shows a pair of rollers, as at 11 and 12, normally contained within a splitter machine, and a splitter machine of the type that is available from Camoga Company, located in Milan, Italy. These machines are quite available in the art, sold extensively, and are generally fabricated having the pair of rollers as shown in FIG. 1. Upon passage of the pattern matrix and its underlying intended shoe component into the skiving machine, the matrix being shown having the upper and lower layers of pattern matrix, as at 1 and 3, and having the relief means, plus cord, located intermediate thereof, as shown at 2, multiple depths of skiving will occur. As explained, when the matrix contains upper and lower abrasive surfaces, upon opposite sides of the matrixes 1 and 3, then a pressure sensitive tacky surface may be contained inwardly of each matrix, to provide for their adhesion together, with the convenient fixed locating of the relief means 2 therebetween. This pattern matrix, when formed, is then fed into the splitter machine with the leather or other material type shoe component 7 facing downwardly, generally with the softer fleshy portion of the hide being disposed downwardly, for pressure feeding into the knife 12*a* of the splitter machine, in order to induce a skiving of those edges of the material 7 determined generally by the locating of the relief means 2 within the formed pattern matrix. The elastic roller will force the material 7 upwardly, so that normally so skiving of any edge of the said material will take place outside of the locating of the relief means 2, but that where the relief means 2 is located, this will force the leather or other material downwardly into the path of the said revolving knife blade, and obtain some skiving or bevelled cutting of select edges of the intended shoe part co-terminus with the locating of the relief means 2 and 5 within the pattern.

Variations and modifications to the structure and usage of this invention may occur to those skilled in the art upon reviewing the subject matter of this disclosure. Such variations, is within the spirit of this invention, are intended to be encompassed by the scope of any claims to patent protection issuing hereon. The description of the preferred embodiment set forth herein is done so for illustrative purposes only, and is not to be considered as limiting of the interpretation of these claims.

Having thus described the invention what is claimed and desired to be secured by Letters Patent is:

1. A pattern matrix for use in conjunction with a splitter machine for skiving select marginal edges of shoe parts in preparation for their folding and fabrication into a shoe, comprising, a pattern matrix formed of a sheet of material and having at least one select edge shaped substantially in the configuration of the shape to be obtained for the intended shoe part to obtain its alignment, relief means provided contiguously along one matrix edge to assure skiving of any overlying shoe part at least at the location of the said relief means, and means provided substantially aligned with the relief means and providing for skiving at a greater depth at the location of said means that can be obtained at the relief means for assuring a weakened fold line along the length of the select skived edge for the shoe part.

2. The invention of claim 1 and wherein said means provided aligned with the relief means comprises a material of greater density than the said relief means.

3. The invention of claim 2 and wherein said means comprises a cord.

4. The invention of claim 3 and wherein said cord is a nylon cord.

5. The invention of claim 3 and wherein said cord is a polymer cord.

6. The invention of claim 5 and wherein said polymer cord is formed of a vinyl.

7. The invention of claims 3, 4, 5, or 6 and wherein said relief means is formed of a fibrous material.

8. The invention of claim 2 and wherein said pattern matrix is formed having an abrasive surface upon the side opposite from the location of the relief means.

9. The invention of claim 2 and wherein said pattern matrix contains a tacky surface upon that side to which the relief means adheres.

10. The invention of claim 9 and including another pattern matrix applied to the tacky side of the first said matrix and having the relief means arranged intermediate therebetween for providing a reversal in the usage of said matrix for fabricating shoe parts of reverse proportions.

11. The invention of claim 10 and wherein said means comprises a cord.

12. The invention of claim 11 and wherein said cord is a nylon cord.

13. The invention of claims 9 or 10 and wherein said tacky surface is pressure sensitive.

14. A pattern matrix for use in conjunction with a splitter machine for skiving select marginal edges of shoe parts in preparation for their folding and fabrication into a shoe, comprising, a pattern matrix formed of at least one sheet of material and having at least one select edge shaped substantially in the configuration of the shape of the intended shoe part for attaining alignment therewith, relief means provided contiguously along said matrix edge to assure skiving of any overlying shoe part at least at the location of the relief means, said pattern matrix containing a tacky surface upon that side upon which the relief means adheres, and another pattern matrix applied to the tacky side of the first said matrix and having the relief means arranged intermediate therebetween for providing for its reverse usage for fabricating shoe parts of reverse proportions.

15. The invention of claim 3 and including therebeing a groove formed in the relief means, and said cord arranged within and along the length of said provided groove.

16. The inventions of claim 9 or 10 and wherein said relief means comprises a cord.

17. The invention of claim 16 and including therebeing a groove formed in the relief means, and said cord being arranged within and along the length of said provided groove.

* * * * *